US005107076A

United States Patent [19]

Bullock et al.

[11] Patent Number: 5,107,076

[45] Date of Patent: Apr. 21, 1992

[54] EASY STRIP COMPOSITE DIELECTRIC COAXIAL SIGNAL CABLE

[75] Inventors: Roddy M. Bullock, San Marcos; Alfredo Cedrone, Austin, both of Tex.

[73] Assignee: W. L. Gore & Associates, Inc., Newark, Del.

[21] Appl. No.: 639,510

[22] Filed: Jan. 8, 1991

[51] Int. Cl.[5] ..... H01B 7/34

[52] U.S. Cl. ..... 174/107; 174/36; 174/115

[58] Field of Search ..... 174/36, 107, 115

[56] References Cited

U.S. PATENT DOCUMENTS

| | | | |
|---|---|---|---|
| 3,680,016 | 8/1972 | Spade | 174/36 |
| 3,775,552 | 11/1973 | Schumacher | 174/105 R |
| 3,927,247 | 12/1975 | Timmons | 174/36 |
| 4,268,714 | 5/1981 | Mori | 174/108 |
| 4,327,246 | 4/1982 | Kincaid | 174/36 |
| 4,481,379 | 11/1984 | Bolick, Jr. et al. | 174/36 |
| 4,588,852 | 5/1986 | Fetterolf et al. | 174/36 |
| 4,638,114 | 1/1987 | Mori | 174/36 |
| 4,697,051 | 9/1987 | Beggs et al. | 174/36 X |
| 4,755,629 | 7/1988 | Beggs et al. | 174/36 X |
| 4,855,534 | 8/1989 | O'Connor | 174/36 |

*Primary Examiner*—Morris H. Nimmo
*Attorney, Agent, or Firm*—Gary A. Samuels

[57] ABSTRACT

A composite dielectric coaxial cable which is easily hand-strippable for termination without disturbing its drain wire or unravelling the metallized tape comprising its shielding layer.

9 Claims, 3 Drawing Sheets

EASY STRIP COMPOSITE DIELECTRIC COAXIAL SIGNAL CABLE

FIELD OF THE INVENTION

The invention pertains to impedance-controlled electric coaxial cables, having a drain wire, which are easily strippable for high density termination.

BACKGROUND OF THE INVENTION

In the manufacture of modern coaxial cables, it is desirable to make the cables as small and lightweight as possible, while at the same time retaining required electrical properties such as controlled impedance and capacitance. Such a coaxial cable can be made by using porous, low dielectric materials between the inner (center) and outer conductors, the outer conductor being comprised of metal foil or metal-plated or metallized plastic tape. The physical size of the cable is dependent on the desired impedance and capacitance, both of which are dependent on the dielectric material used, and the distance between the inner and outer conductors. Therefore, for a given dielectric material, the required electrical characteristics dictate the overall diameter of the coaxial cable. A difficulty arises when terminating a multi-coaxial cable into a high pin-density connector. In a multi-pin connector, the pins are generally on 0.050 inch center to center spacing. If the overall diameter of the coaxial cables to be terminated is significantly larger than 0.050 inch, intermediate termination steps must be used. The intermediate steps include stripping the insulation back on the center conductor and splicing in another wire of the proper diameter to be soldered or crimped into the pin of the connector. Additionally, the helically-wrapped outer conductor must be cut back to expose any necessary drain wires used for termination. After connecting the drain wire, the outer conductor must be sealed in place to prevent unravelling during use. The sealing in place of the outer conductor is generally done with the use of heat-shrinkable tubing. The invention provides a cable which avoids multiple termination steps by allowing one-step stripping of the dielectric material to an intermediate diameter to suit the connector without damaging the drain wire or causing the outer conductor to unravel.

SUMMARY OF THE INVENTION

The coaxial electrical signal cable of the invention comprises a solid or stranded metal center conductor surrounded by a continuous porous insulation of low dielectric constant, preferably of tape-wrapped expanded polytetrafluorethylene (PTFE), which is covered with a second continuous dielectric layer of an extruded polymer, preferably of fluorinated ethylene-propylene (FEP) in intimate contact with, but not adhered to, the first layer of dielectric. A solid or stranded drain wire is arranged parallel to the above core construction, and the drain wire and core are helically-wrapped with a metal-plated or metallized polymer tape, preferably an aluminized tape such as aluminized polyester tape. The aluminized tape is prepared such that one edge of the polyester tape is not aluminized. This results in a tape with one metal-free edge. A heat-sealable adhesive, such as polyester for example, is then coated on the metal-free edge of the aluminized polyester tape. The adhesive is applied on the same side of the tape as the aluminum. When helically-wrapped around the composite dielectric core, the metal-free edge of the tape overlaps the previous wraps, with the adhesive on the metal-free edge contacting the layer of tape underneath it. The adhesive on the tape-wrapped outer conductor is then heat-sealed to form a firmly unitized layer having no tendency to unravel or uncoil and which does not stick to the drain wire or dielectric core. A standard polymer jacket may be extruded or wrapped over the aluminized polyester layer to give additional protection.

The cable of the invention is prepared for termination by stripping an end of the cable with a modified hand stripping tool, of a type well known in the art, which grasps the cable firmly, cuts through the outer aluminized polyester conductor and into the second layer of the composite dielectric. The blades of the stripper then pull the aluminized polyester and second dielectric layer off as a slug in one continuous coordinated movement. To do the stripping, the stripper must be modified such that the cutting bar of the stripping tool is notched to avoid cutting the drain wire of the cable as the outer conductor and second dielectric layers are removed. After the stripping process, the adhesive on the edge of the helically-wrapped aluminized polyester prevents unravelling of the tape on the remaining core. The cut material of the cable end can be freely removed, leaving the drain wire and inner dielectric layer intact. The remaining core, consisting of the porous inner dielectric material over the center conductor, may now be easily terminated onto a pin of a high pin-density connector along with other similar conductors.

DETAILED DESCRIPTION OF THE INVENTION

The invention is now described with reference to the figures to more fully describe and delineate the invention.

Figure 1:
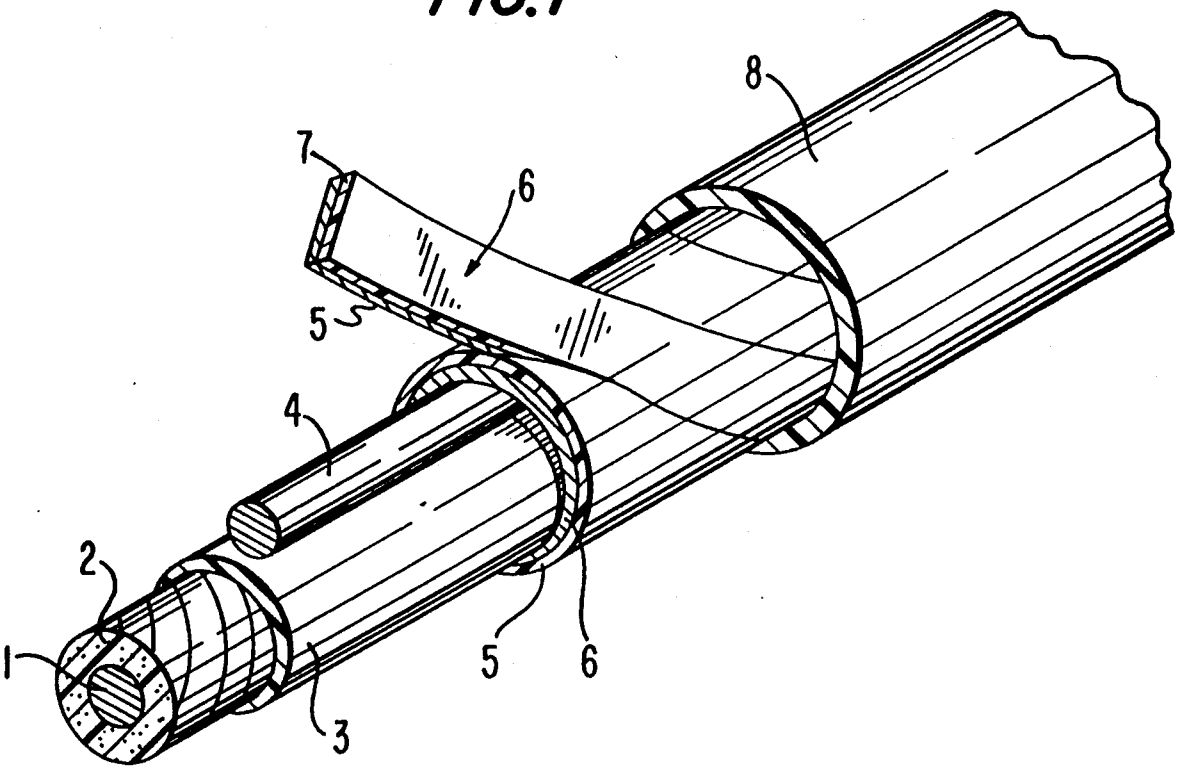
FIG. 1 shows in cross-sectional perspective view a cable of the invention with layers peeled away for easier identification of components of the cable.

FIG. 1 shows a perspective cross-sectional view of a cable of the invention comprising a metal signal conductor 1 surrounded by low dielectric constant insulation 2, which may be applied either by helically wrapping a porous organic polymeric tape around conductor 1 or extruding a porous organic polymer material around conductor 1. Conductor 1 may be solid or stranded and comprises plated copper, copper alloys, or aluminum metal. Insulation 2 preferably comprises tape-wrapped expanded polytetrafluoroethylene (PTFE), but may be any organic insulative material having a low dielectric constant, such as porous polypropylene or polyethylene, a foamed polymer, or other insulative material known in the art to possess the requisite properties for this application. The preferred PTFE materials are those disclosed in U.S. Pat. Nos. 3,953,566, 4,096,227, 4,187,390, 4,902,423, or 3,962,153, assigned to W. L. Gore & Associates, Inc.

In the present invention, the insulation 2 is made up of layers of a helically-wrapped tape of expanded PTFE. The outside layers of insulation 2 are unsintered at the time of wrapping, then sintered to thermoset. The sintering process makes a unitized layer and a non-stick surface which prevents the insulation 3 from sticking to insulation 2 during the stripping process, and prevents insulation 2 from unwrapping after stripping.

Over insulation 2 is extruded, or alternatively tape-wrapped, a polymer 3. In the present invention, the polymer is extruded fluorinated ethylene propylene (FEP), but may be any thermoplastic or thermosetting polymer or elastomer which does not adhere strongly to layer 2.

The thickness of layer 2 is dependent on the connector spacing. The thickness of layer 3 is such that when the core is wrapped with the outer conductor, the proper electrical characteristics are achieved. Electrical characteristics such as the impedance and capacitance between the conductors of a coax are dependent on the spacing between the inner and outer conductors.

Figure 2:
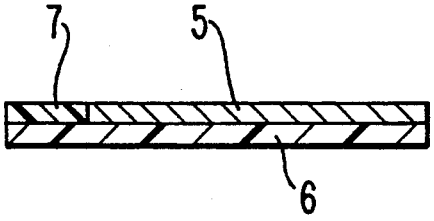
FIG. 2 displays a cross-sectional view of the outer conductor in tape form.

For ease of termination, a solid or stranded conductive metal drain wire 4 is placed along the core of the signal cable, either parallel, or helically-wrapped. The core and drain wire as a unit is helically-wrapped with an outer conductor comprising a polymer tape 6, preferably of polyester, having plated or coated on it a conductive metal layer 5, preferably aluminum. Metal layer 5 extends to only one edge of tape 6 as described above. On the metal-coated edge of tape 6 is placed a coating of adhesive 7. FIG. 2 depicts in a cross-sectional view an aluminized polyester tape used in the invention. During the heat-sealing process, the strip of adhesive 7 adheres to previous coils of tape laid down to anchor them in place against forces exerted in the stripping and termination processes utilized to terminate a cable of the invention. Metal layer 5 contacts drain wire 4 along the length of the cable and provides for termination of the outer conductor in an ordinary fashion. As with any coaxial signal cable, a protective polymer jacket 8 may be placed on the outside of the cable. Jacket 8 may comprise materials customarily used for jacketing, such as thermoplastic polymers, elastomers, or thermosetting polymers.

Figure 3:
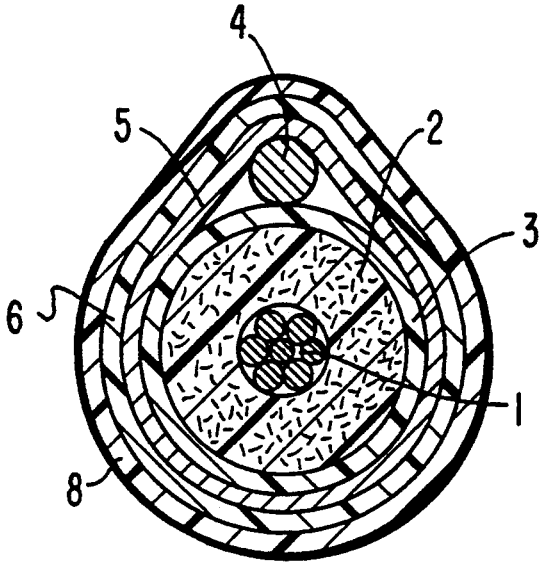
FIG. 3 discloses a cross-sectional view of a cable of the invention.

FIG. 3 displays the various layers of the cable in a cross-sectional view to show their spatial relationship (not in true scale) before the cable is cut and stripped.

Figure 4:
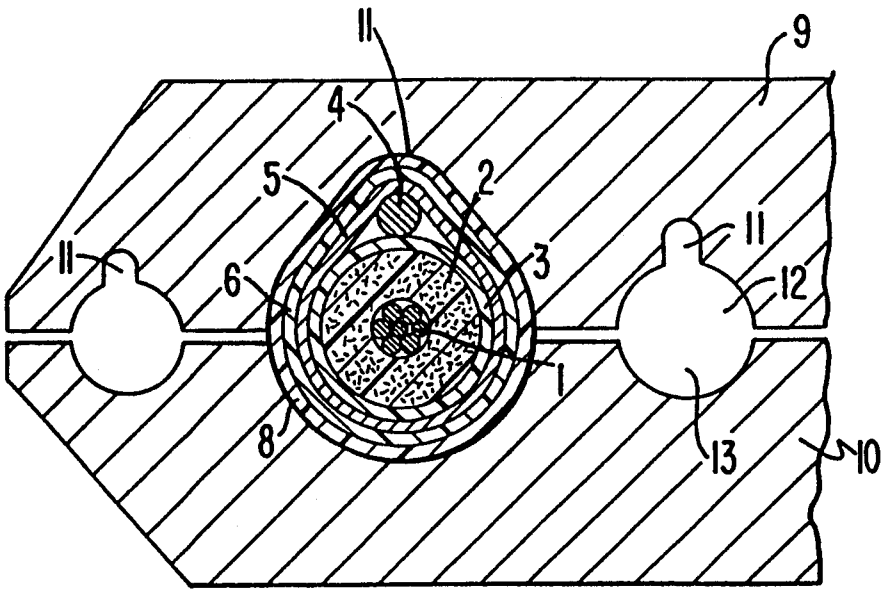
FIG. 4 describes in a cross-sectional view a cable of the invention cut to a desired depth in the cutting bars of the jaws of a stripping tool.

FIG. 4 shows a cross-sectional view of the cutter bar portions of a hand stripping tool of a type known in the art. such as those described in U.S. Pat. Nos. 4,703,674, 3,821,909, 2,313,793, 1,730,980, and 1,196,322, for example. Notches 12 of different sizes to match different cable diameters or cable core diameters are shown in cutter bars 9 and 10. The size of notch 12 is chosen such that it is slightly larger than the core 2 which will remain on the center conductor after stripping. Notches 12 are further notched 11 to accommodate the drain wire 4 so as to leave the drain wire uncut in the stripping process. The tool shown in FIG. 4 is shown having cut through layers 8, 6, 5, and 3, leaving the drain wire 4, and layer 2 of the insulation uncut. After pushed off as a slug of material, leaving the uncut layer 2 and the drain wire 4 intact. Other size notches in the tool could be selected to strip cables with different diameters of insulation 2. If after the first stripping has been done, it is desired to strip insulation 2 to facilitate termination of center conductor 1, a traditional stripping process may be used.

Thus the cable of the invention may be advantageously stripped to the outside diameter (O.D.) of insulation 2 without disturbing the drain wire 4 or unravelling the layers of the outer conductor 5, and 6. Several termination process steps are eliminated and the time to terminate the cable is significantly reduced over similar cables not having such features.

We claim:

1. A coaxial electric signal cable comprising:

(a) a core consisting of a metal center conductor surrounded by a first layer of tape-wrapped expanded polytetrafluoroethylene insulation, then a second layer of polymeric insulation, wherein the second layer of insulation is in intimate contact with, but not adhered to, the first layer;

(b) a conductive metal drain wire arranged parallel to said core;

(c) an outer conducting layer surrounding said core and said drain wire, comprising a helically-wrapped metal-coated polymer tape, metal side contacting said drain wire, and having a strip of heat-sealable adhesive on an edge of said tape on the same side of the tape as that bearing said metal; and (d) a protective jacket;

wherein the outer portion of said first layer of insulation is sintered to thermoset after wrapping.

2. A cable of claim 1 wherein the radial thickness of said first layer is such that high-density termination to a multiconnector pin may be accomplished.

3. A cable of claim 1 wherein the radial thickness of said second layer is such that the required impedance and capacitance values are achieved between said inner and outer conductors.

4. A cable of claim 1 wherein said metal on said metal-coated polymer tape partially covers one side of said polymer tape to leave a continuous strip of metal-free tape adjacent said metal layer and said heat-sealable adhesive is applied to said tape on the same side as said metal layer on the edge of said strip which is metal-free.

5. A cable of claim 4 wherein said heat-sealable adhesive is applied to the opposite side of said tape as said metal.

6. A cable of claim 4 wherein said adhesive is a heat-sealable thermoplastic.

7. A cable of claim 1 wherein said drain wire is helically-wrapped around said core.

8. A cable of claim 1 wherein the metals of said signal conductor, said drain wire, and said outer conductor are selected from the group consisting of copper, metal plated copper, copper alloys, and aluminum.

9. A cable of claim 1 wherein said metal-coated polymer tape comprises polyester.

* * * * *